US006035799A

United States Patent [19]

Lukanovich et al.

[11] Patent Number: 6,035,799

[45] Date of Patent: Mar. 14, 2000

[54] SAIL OR SURF BOARD TO KAYAK CONVERSION KIT

[75] Inventors: K. Louis Lukanovich, Monfort; Trent John Hague, Morin Heights, both of Canada; Wolfgang Kolbl, Abingdon, United Kingdom

[73] Assignee: Quebec Inc., Wentworth-North, Canada

[21] Appl. No.: 09/124,858

[22] Filed: Jul. 30, 1998

[51] Int. Cl.[7] ..... B63B 8/00

[52] U.S. Cl. ..... 114/343; 114/347; 114/363; 441/74

[58] Field of Search ..... 114/343, 347, 114/363, 364, 39.12; 440/104, 105; 441/65, 74

[56] References Cited

U.S. PATENT DOCUMENTS

| | | | |
|---|---|---|---|
| 3,587,123 | 6/1971 | O'Boyle | 114/364 |
| 4,511,338 | 4/1985 | Fanelli . | |
| 4,752,261 | 6/1988 | Rosello Zoya . | |
| 4,873,935 | 10/1989 | Lustig | 114/347 |
| 5,377,607 | 1/1995 | Ross . | |

FOREIGN PATENT DOCUMENTS

| | | | |
|---|---|---|---|
| 3511042 | 10/1986 | Germany | 441/74 |
| 8403786 | 7/1986 | Netherlands | 441/74 |

*Primary Examiner*—Stephen Avila
*Attorney, Agent, or Firm*—F. Martineau

[57] ABSTRACT

A seat and foot rest assembly to convert a surf board or sail board into a kayak type paddling craft. The assembly comprises a chassis, connectors to easily secure said chassis to the top wall of the water buoyant board, a seat secured to the rear portion of the chassis and a foot rest adjustably mounted on the front section of the chassis. The connectors include suction cups and board encircling straps or screws to be screwed within screw inserts carried by the board top wall. The conversion kit can easily be detached to allow the user to use the board in its original configuration. An optional steering mechanism is provided for more precise directional control of the craft. The steering mechanism includes a stern mounted rudder and a control stick operable by the user's feet and connected to the rudder by adjustable cables.

12 Claims, 7 Drawing Sheets

SAIL OR SURF BOARD TO KAYAK CONVERSION KIT

FIELD OF THE INVENTION

The present invention relates to an accessory arrangement for converting a water buoyant board such as a sail board or surf board into a kayak type paddling craft.

BACKGROUND OF THE INVENTION

Water sports are becoming increasingly popular. Costs and physical size constraints can prevent the use of kayaks in a large number of cases and use of surf and sail boards is often prevented due to lack of wind or waves.

A conversion kit to convert a sail or surf board into a water bicycle is described in U.S. Pat. No. 4,511,338 dated Apr. 16, 1985 entitled "Water bicycle and detachable device therefor", inventor Noël Fanelli.

Another conversion kit is described in U.S. Pat. No. 5,377,607 dated Jan. 3, 1995 entitled "Conversion arrangement for sail board with seat", inventor Gerald S. Ross. Still another conversion kit is described in U.S. Pat. No. 4,752,261 dated Jun. 21, 1988 entitled "Auxiliary seat for surf boards", inventor Michael A. Rosello Zoya.

The Fanelli patent describes the use of board encircling straps to secure the conversion kit to the board but otherwise has no relation to a kayak type paddling craft. The Ross patent shows in FIG. 3 the board used as a kayak, however the seat is adjustable but not the foot rest, therefor the seat cannot be conveniently positioned in the region of the buoyant center of the board irrespective of the user's height.

The Zoya patent shows an arrangement in which the distance between the foot rest and seat can be adjusted to suit the height of the user but the kit frame rests flat on the surf board and therefore could not conveniently clear feet anchoring straps and mast anchors normally portruding form the top wall of a sail board. Also, adjustment of the distance between the foot rest and seat is difficult to achieve.

OBJECT OF THE PRESENT INVENTION

It is therefore the main object of the present invention to provide a conversion kit of the character described which obviates the above noted disadvantages, more particularly in which the foot rest is adjustable with respect to the seat for maximum comfort and performance.

Another object of the invention is to provide a conversion kit of the character described in which the foot rest and seat are mounted on a chassis which is spaced above the top wall of the board so as to clear the feet anchoring straps and the mast anchor normally found on a sail board.

Another object of the present invention is to provide a conversion kit of the character described incorporating a steering assembly including a foot rest mounted control stick accessible to the user's feet and connected to the stern mounted rudder via adjustable cables, maintained taut despite the variable distance between the adjustable foot rest and the seat.

Another object of the invention is to provide a converted craft which, depending on the type of basic board being used, emulates closely the performance of river flat water racing and recreational kayaks and surf ski and wave ski kayaks and as such may be used for training and recreational purposes.

SUMMARY OF THE INVENTION

The present invention relates to an accessory arrangement for converting a water buoyant board such as a sail board or surf board into a kayak type paddling craft, said board having a bow, a stern and a top wall. Said arrangement comprises a chassis including a pair of spaced generally parallel rails; first connectors to firmly secure said chassis to said board over said top wall with said rail excending longitudinally of said board, each rail having a rear end portion and a front end portion, a seat extending transversely of slidable and secured to said rear end portions, a foot rest extending transversely of and slidable over said front end portions, and adjustable second connectors for releasably securing said foot rest to said front end portion in longitudinaly adjusted position therealong, whereby a user, seated on said seat with his legs on said foot rest and facing towards said bow, may use a double paddle oar for propulsion.

Preferably, said foot rest has a user's feet engaging surface facing said seat and downwardly rearwardly enclined.

Preferably such chassis defines a rectangular frame, said rails forming the longitudinal sides of said frame and further including cross-members rigidly interconnecting said front and rear end portions and forming the shorter size of said frame.

Preferably, said first connectors includes four (4) suction cups located at each corner under said chassis for adhering to said top wall.

Preferably, said first connectors further include board encircling flexible straps attached to said chassis and strap tighteners for said straps.

The straps may be replaced by screw inserts in said board top wall and screws carried by said chassis to be screwed into said screw inserts. Save for the screw inserts, no help, no tools and no external device is required to secure the invention to a board.

Preferably, the accessory arrangement further includes a steering mechanism comprising a rudder mounting plate to be secured to said stern, a rudder pivotally carried by said plate, a rudder actuator lever rearwardly protruding from said feet abuting surface and located centrally thereof, transversely of said chassis, an upright pivot rod journaled in said foot rest forwardly of said surface and to the upper end of which said lever is secured, and a cable system connecting said pivot rod and said rudder to transmit feet induced pivoting movement of said lever to said rudder.

Preferably, each of said rails forms a channel, said cable system including a pair of cables extending within the respective channels.

Preferably, the steering mechanism includes effective cable length adjusters to maintain the cables taut between said pivot rod and rudder in any selected ajusted position of said foot rest.

The present invention also relates to a kayak type water craft comprising a combination in water buoyant, narrow elongated board and the above defined accessory arrangement fitted to the board.

DETAILED DESCRIPTION OF THE PREFERRED EMBODIMENTS

Figure 1:
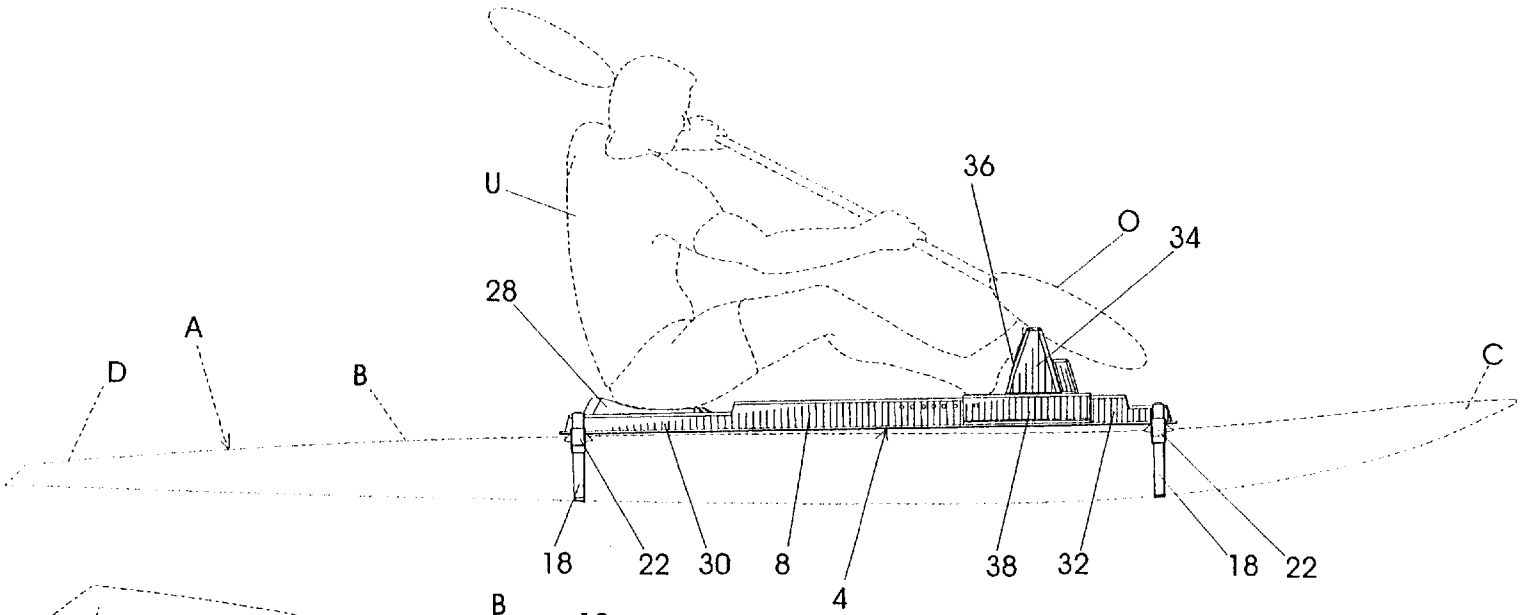
FIG. 1 is a side elevation of a sail board fitted with the conversion kit of the present invention and showing a user in paddling position.
Figure 2:
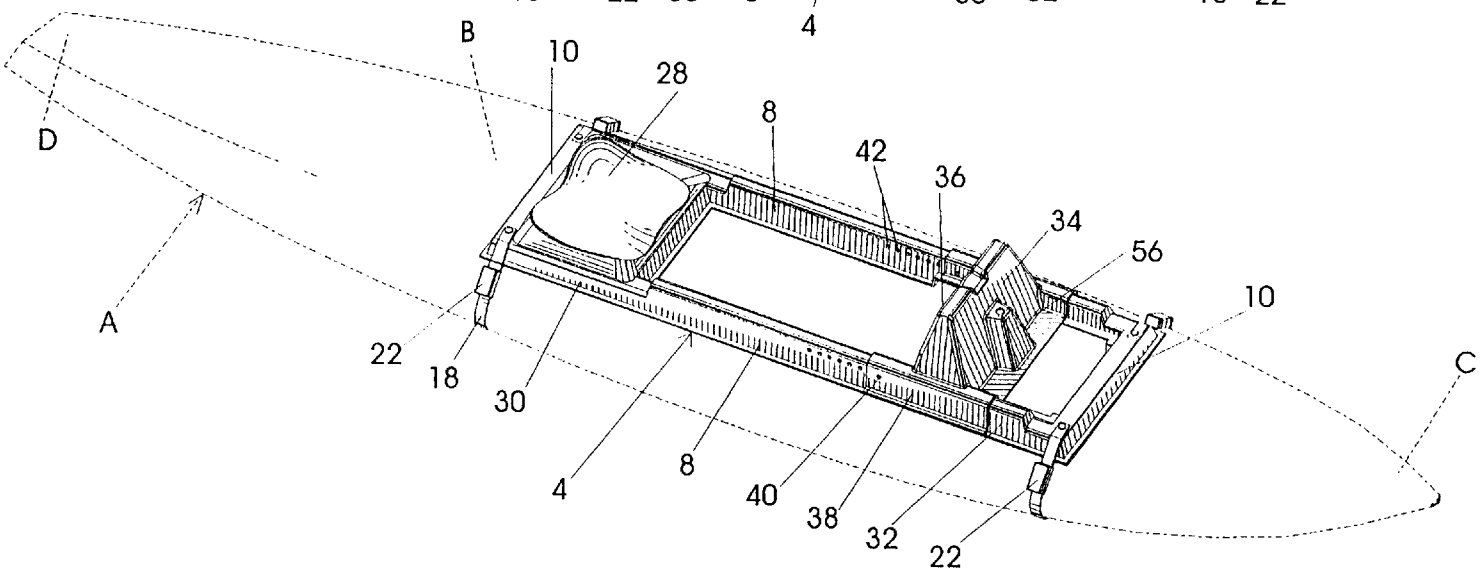
FIG. 2 is a perspective view of the assembly of FIG. 1.
Figure 3:
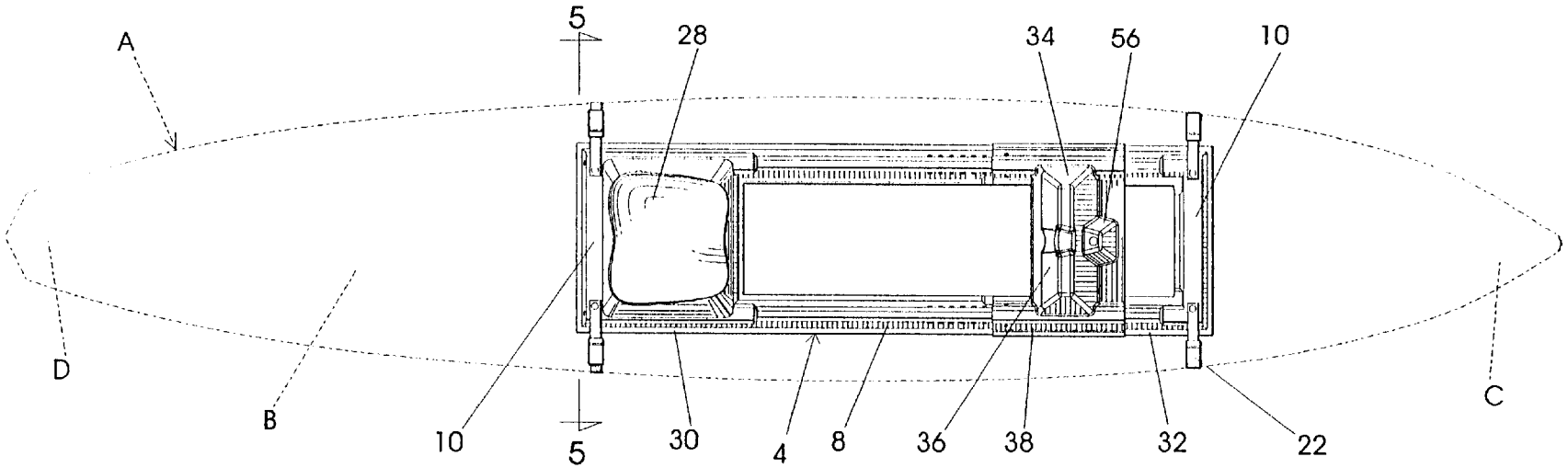
FIG. 3 is a top plan view of the assembly of FIG. 1.
Figure 4:
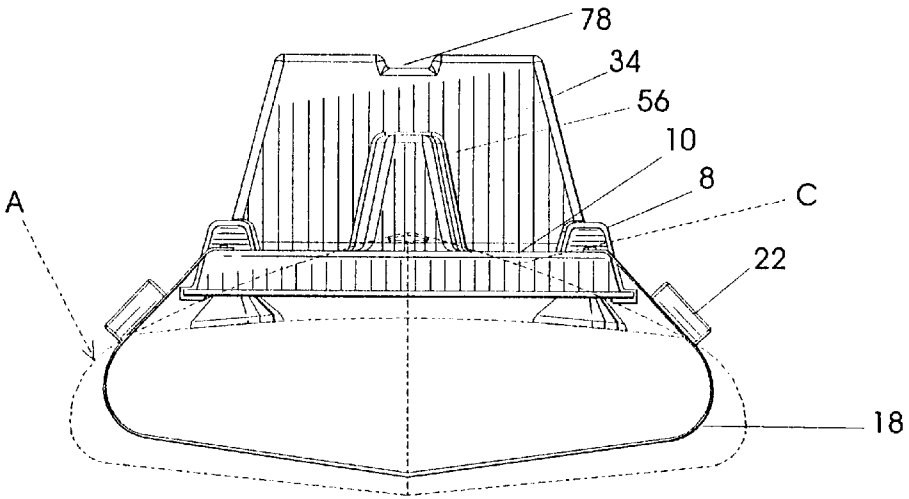
FIG. 4 is a front view of the assembly of FIG. 1.

FIG. 1 shows a conventional sail board A, with a top wall B, a bow C and a stern D.

The conversion kit or accessory arrangement in accordance with the present invention, when installed on board, enables a user U to ride the resulting craft as a kayak type paddling craft, using a hand held double paddle oar O while facing toward bow C.

Figure 5:
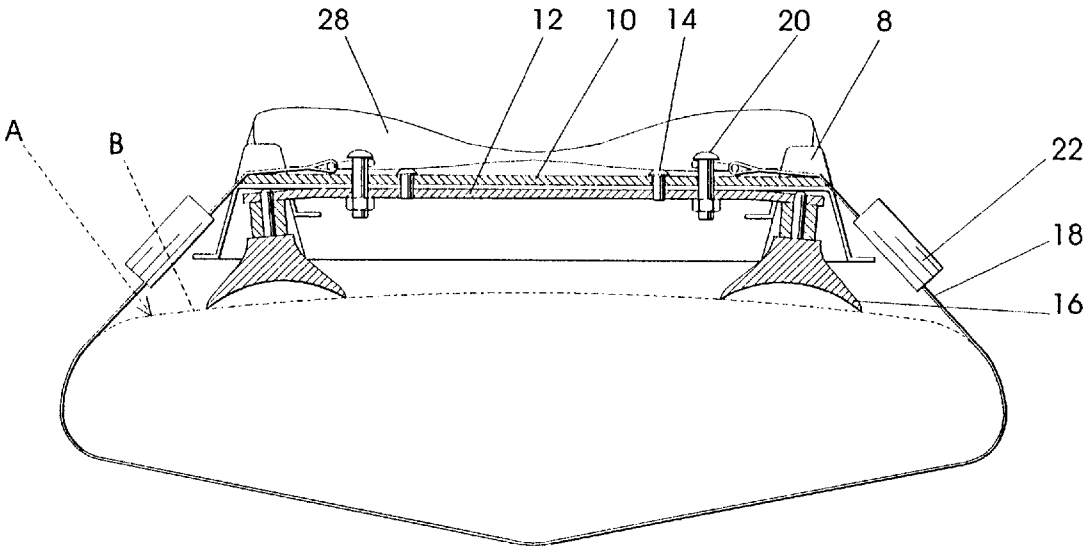
FIG. 5 is a cross-section taken along line 5—5 of FIG. 3.

The conversion kit of the invention comprises a chassis 4 of generally rectangular shape and composed of longitudinal rails 8 and front and back cross-members 10 rigidly interconnecting the rails 8. As shown in FIG. 5, a flat bar 12 is secured by bolts 14, underneath each cross-member 10, and suction cups 16 are secured to the ends of each flat bar 12 to adhere to the top wall B of sail board A; board encircling straps 18 are secured at their ends to strap anchor bolts 20 secured to the cross-members 10 and underlying flat bars 12. Each strap 18 is provided with strap tighteners 22 of conventional construction. By tightening the straps, the suction cups are flattened against the board and yet the chassis 8, 10 is firmly held in upwardly spaced relationship with the top wall B so that it will clear any portruding parts of the sail board such as its foot anchoring straps and mast anchors.

Figure 6:
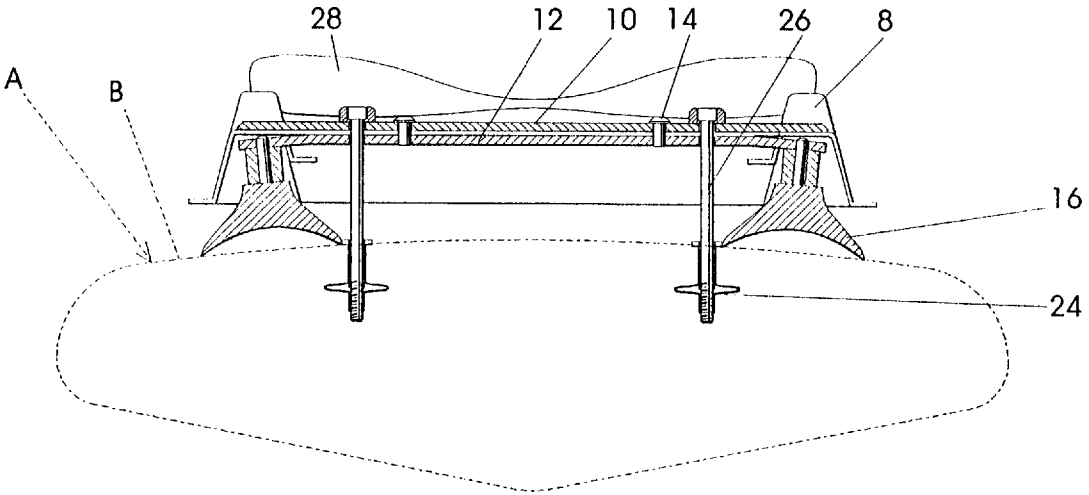
FIG. 6 is a cross-section similar to that of FIG. 5 but showing another embodiment of the anchoring system.
Figure 7:
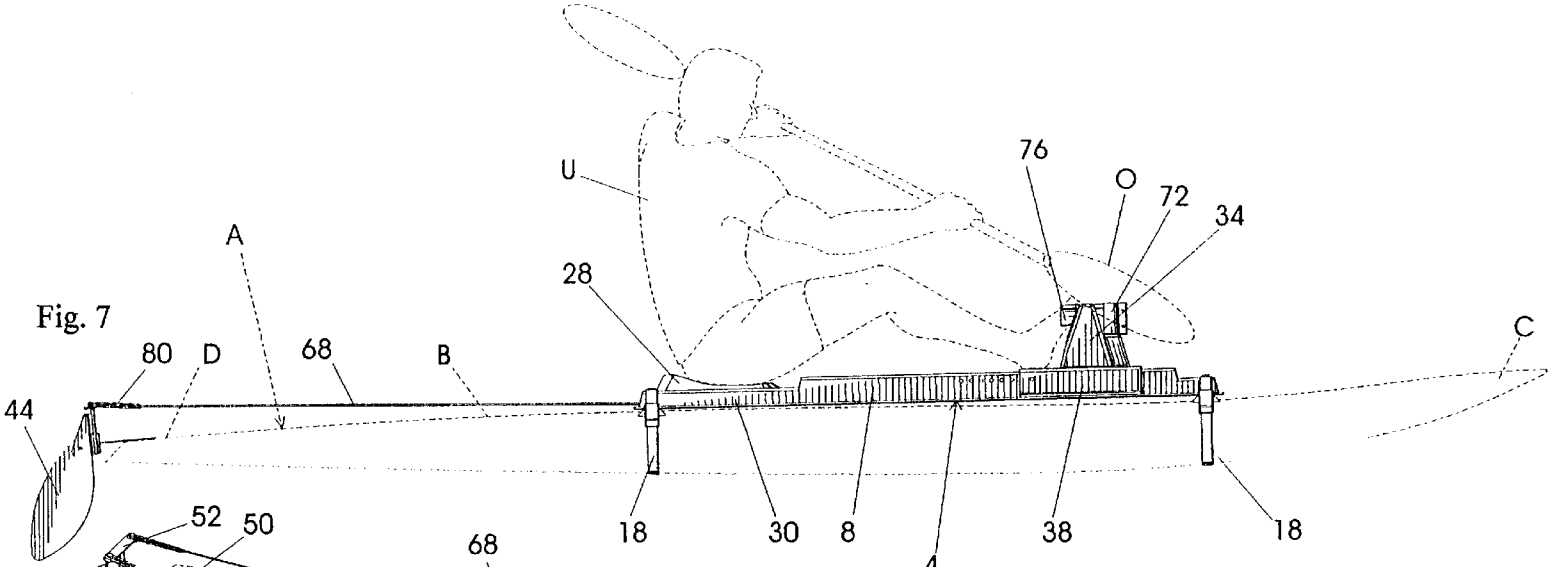
FIG. 7 is a side elevation similar to FIG. 1 but showing the addition of a steering assembly.
Figure 8:
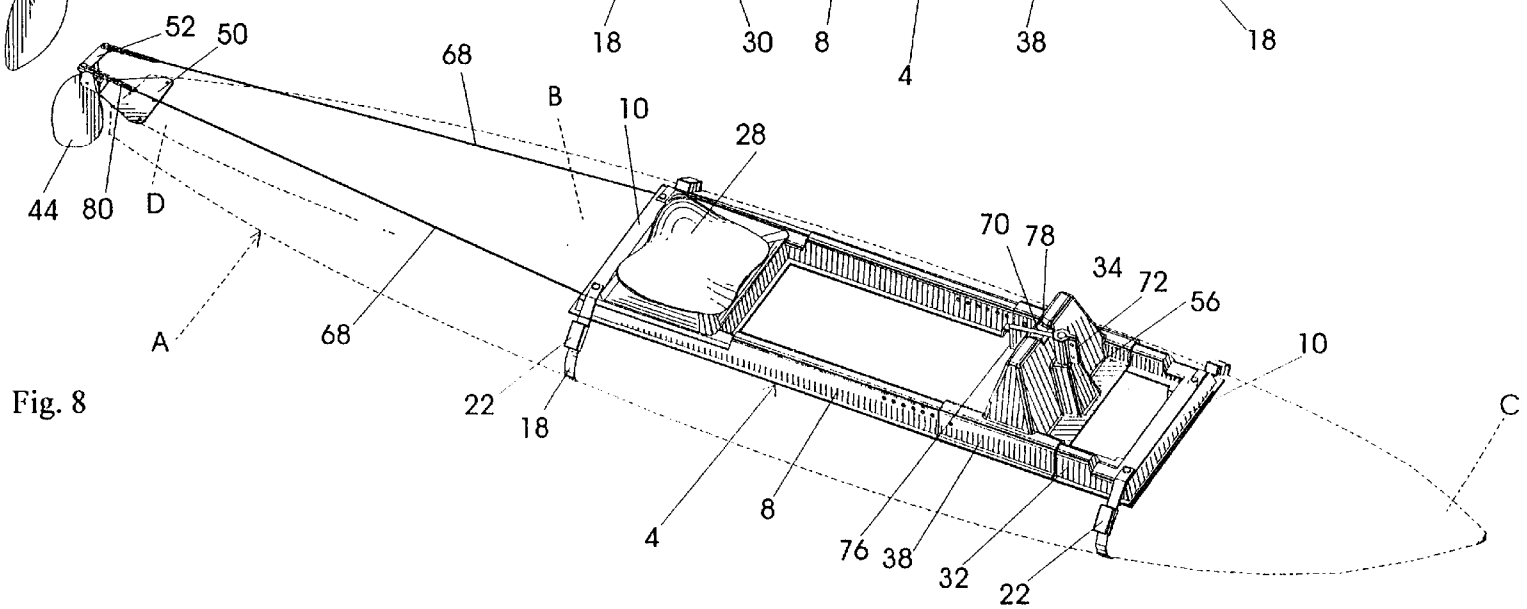
FIG. 8 is a perspective view of the embodiment of FIG. 7.
Figure 9:
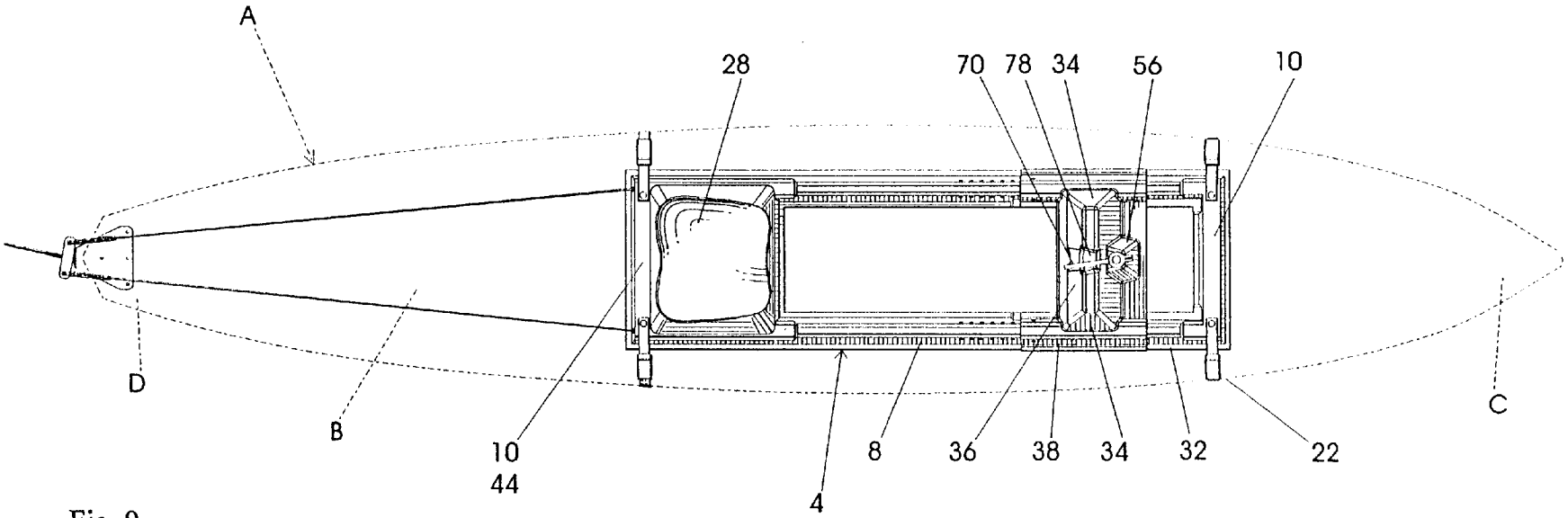
FIG. 9 is a top plan view of the embodiment of FIG. 7.

In an alternative arrangement as shown in FIG. 6, the board encircling straps 18 are replaced by another anchoring system including screw inserts 24 permanently positioned within the top wall B and screws 26 carried by the cross-members 10 and flat bars 12 and conveniently screwed within screw inserts 24. After removal of the chassis, screw inserts 24 are closed by conventional plugs.

A molded seat 28 is permanently secured to the rear end portion 30 of each rail 8, the seat extending across board A; front end portions 32 of both rails 8 support a foot rest 34 of inverted V shape cross-section which includes a feet abutting wall 36 which faces rearwardly of the craft and is downwardly rearwardly inclined. Foot rest 34 further includes a pair of slide members 38 of channel shape fitting over the channel shaped rails 8 of the chassis 4.

Figure 11:
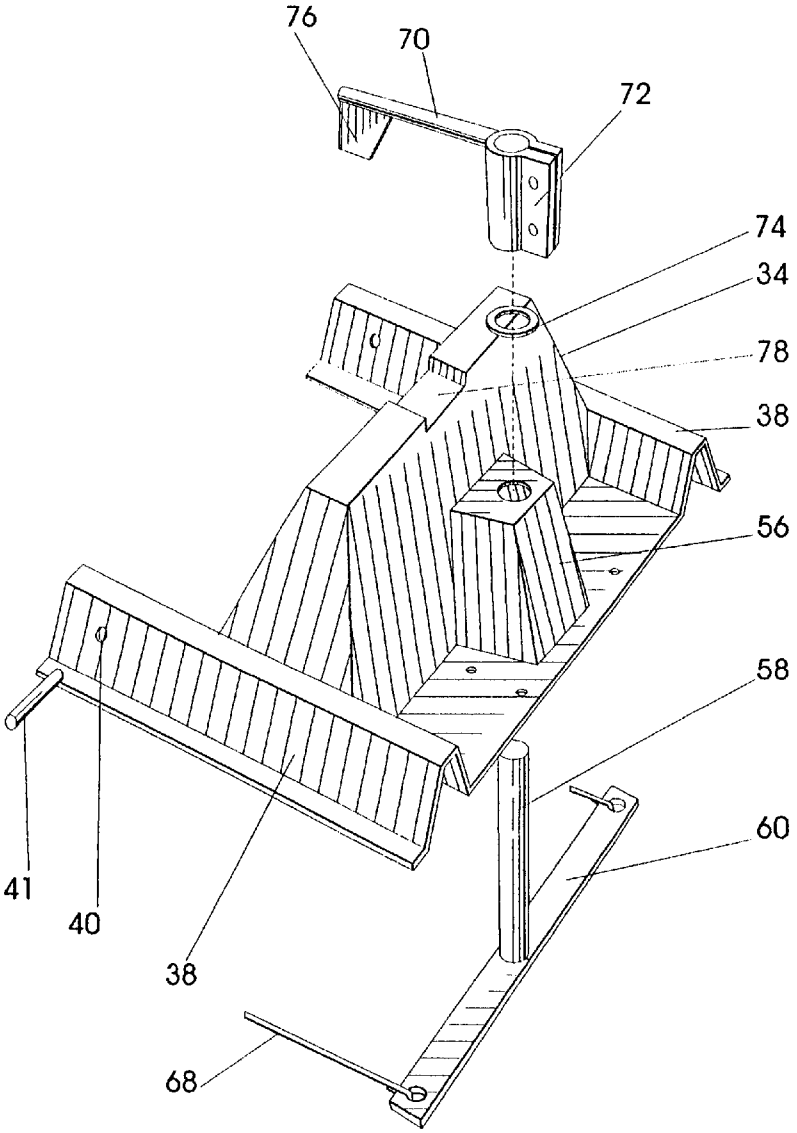
FIG. 11 is an exploded perspective view of the foot rest and rudder control mechanism.
Figure 10:
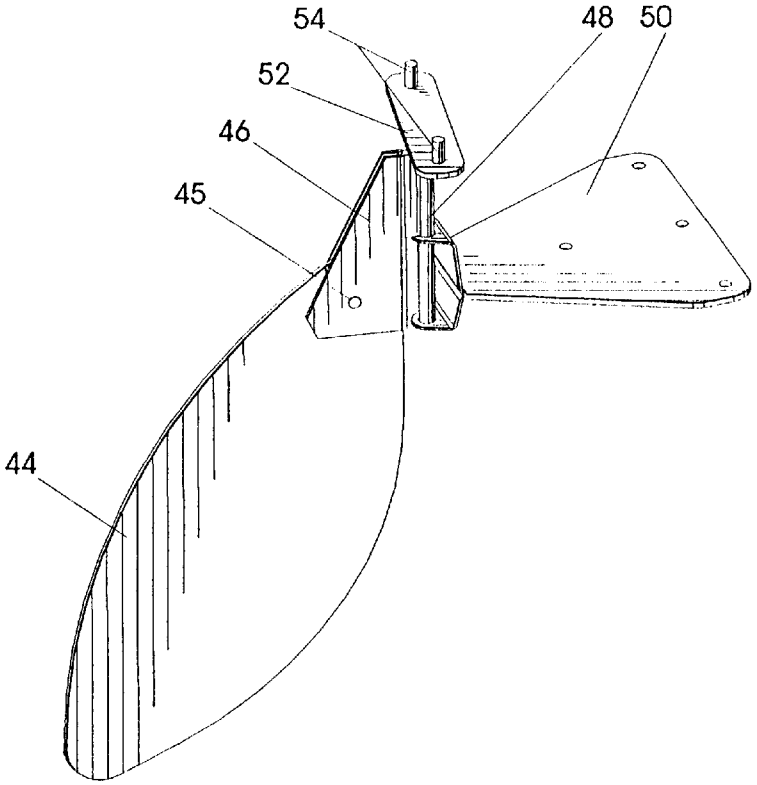
FIG. 10 is a perspective view of the rudder.
Figures 12, 13:
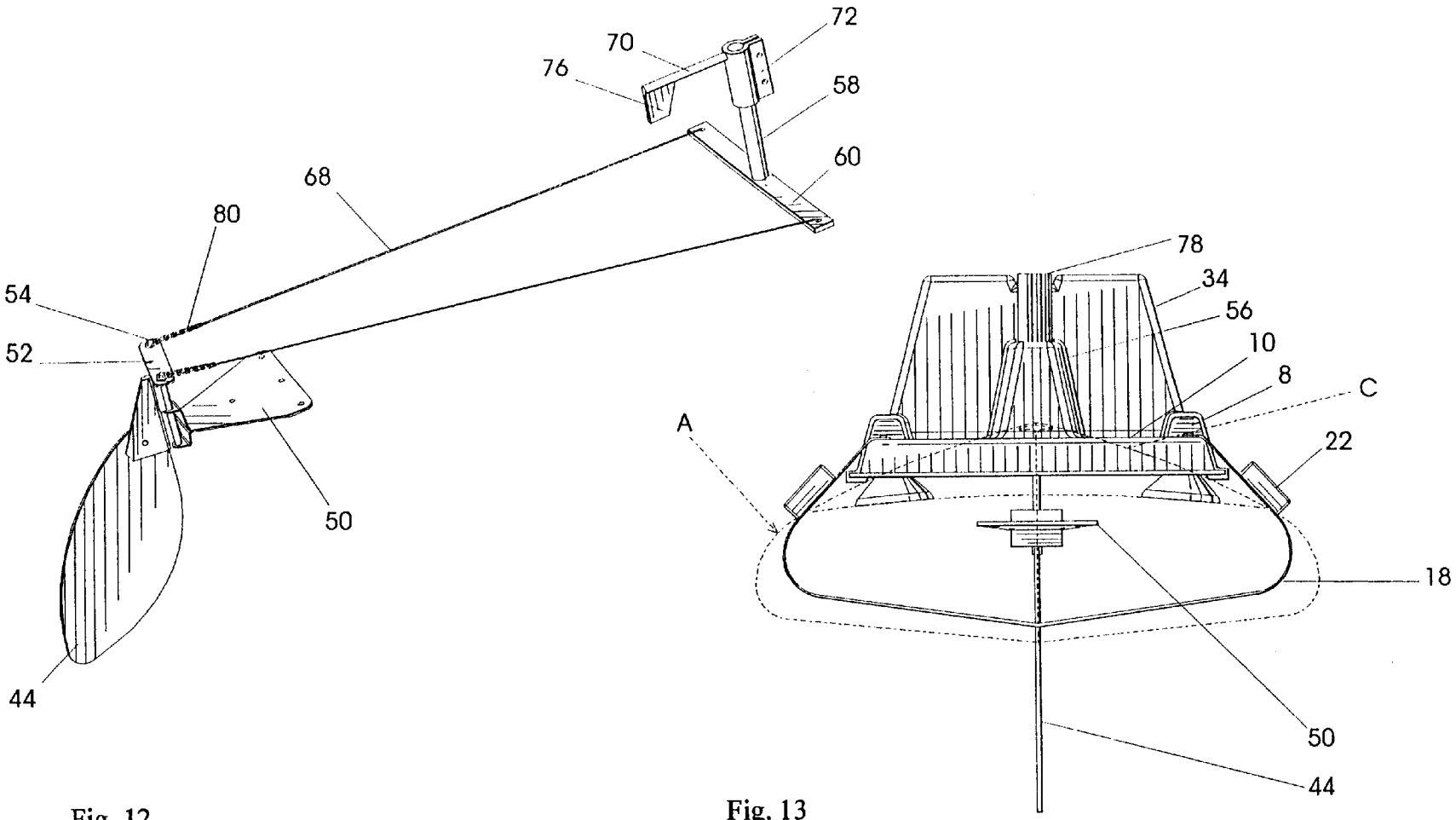
FIG. 12 is a perspective view of the assembled rudder and its control.
FIG. 13 is a front view of the embodiment of FIG. 7.

The slide members 38 are provided with a hole 40 adapted to come in selecting register with anyone of several locating holes 42 made in the rails 8 for insertion of a locking pin 41 (FIG. 11). Therefore, the foot rest can be longitudinally adjusted and locked in adjusted position.

It is obvious that the chassis 8,10 can be adjustably secured on the board A longitudinally of the latter so as to position the seat 28 in the region of the buoyant center of the board A to obtain a minimum of water resistance when the user U is paddling. The foot rest can then be adjusted along rails 8 for maximum paddling efficiency and comfort of the user in accordance with his height.

The feet abutting surface 36 has a sufficient area to receive user's feet in side by side position and is conveniently downwardly rearwardly inclined so that the user's feet can exert a maximum pressure on the same when the user is paddling.

Since surf board A is quite narrow, and user U sits higher on the same, oar O, when paddling, easily clears the sides of the sail board A.

The accessory arrangement 4 can be optionally fitted with a rudder system which includes an over stern rudder 44 (see FIGS. 7 to 12) which is secured at 45 to a rudder bracket 46 fitted with a pivot rod 48 pivotally mounted on a mounting plate 50 to be secured to the stern D by suitable fasteners. A double arm 52 is secured to the top of the pivot rod 48 and carries studs 54 which are equally spaced from rod 48. Foot rest 34 has a front protuberance 56 forming a journal for a control rod 58 to the lower end of which is secured a double arm control 60. A pair of steering cables 68 running longitudinally of the board and under rails 8, are attached at their ends to the outer ends of the two double arms 52 and 60.

A control stick 70 is secured to the top end of control rod 58 by means of its flanged split sleeve 72 and with the interposition of a washer 74. Control stick 70 has an enlarged free end portion 76 which extends between the user's feet so as to be pushed right or left by the same; control stick 70 freely extends within a top notch 78 of foot rest 34.

The effective length of each cable 68 can be adjusted; for instance each cable 68 is terminated by a chain 80, any chain link of which can be selectively fitted over a stud 54 of rudder double arms 52. Therefor cables 68 are maintained taut between double arm 52 and 60 irrespective of the longitudinally adjusted position of foot rest 34.

The embodiments of the invention, in which an exclusive property or privilege is claimed, are defined as follows:

1. An accessory arrangement for converting a water buoyant board such as a sail board or surfboard into a kayak type paddling craft, said board having a bow, a stern and a top wall, said arrangement comprising a chassis including a pair of spaced generally parallel rails; first connectors to firmly secure said chassis to said board over said top wall with said rails extending longitudinally or said board, each rail having a rear end portion and a front end portion, a seat extending transversely of and secured to said rear end portions, a foot rest extending transversely of and slidable on said front end portions; adjustable second connectors for releasably securing said foot rest to said front end portions in longitudinally adjusted position therealong, whereby a user, seated on said seat with his legs on said foot rest and facing towards said bow, may use a double paddle oar for propulsion:

wherein said first connectors includes at least a few suction cups secured to and located under said chassis for adhering to said top wall, and screws carried by said chassis to be screwed into screw inserts in said top wall.

2. An accessory arrangement as defined in claim 1, wherein said foot rest has a user's feet engaging surface facing said seat and downwardly rearwardly inclined.

3. An accessory arrangement as defined in claim 2, wherein said chassis defines a rectangular frame, said rails forming the longer sides of said frame and further including cross-members rigidly interconnecting the front and rear end portions of said rails and forming the shorter sides of said frame.

4. An accessory arrangement for converting a water buoyant board such as a sail board or surfboard into a kayak type paddling craft, said board having a bow, a stern and a top wall, said arrangement comprising a chassis including a pair of spaced generally parallel rails; first connectors to firmly secure said chassis to said board over said top wall with said rails extending longitudinally of said board, each rail having a rear end portion and a front end portion, a seat extending transversely of and secured to said rear end portions, a foot rest extending transversely of and slidable on said front end portions; adjustable second connectors for releasably securing said foot rest to said front end portions in longitudinally adjusted position therealong, whereby a user, seated on said seat with his legs on said foot rest and facing towards said bow, may use a double paddle oar for propulsion; said footrest having a user's feet engaging surface facing said seat and downwardly rearwardly inclined;

further including a steering mechanism comprising a rudder mounting plate to be secured to said stern, a rudder pivotally carried by said plate, a rudder actuator lever rearwardly protruding from said feet abutting surface and located centrally thereof, transversely of said chassis, an upright pivot rod journaled in said footrest forwardly of said surface and to the upper end of which said lever is secured, and a cable system connecting said pivot rod and said rudder to transmit feet induced pivoting movement of said lever to said rudder.

5. An accessory arrangement as defined in claim 4, wherein each of said rails forms a channel, said cable system including a pair of cables extending under the respective channels.

6. An accessory arrangement as defined in claim 4 wherein said cable system includes a pair of cables and effective cable length adjusters to maintain said cables taut between said pivot rod and rudder in any selected adjusted position of said foot rest.

7. An accessory arrangement as defined in claim 5, further including cross-members rigidly interconnecting the front and rear end portions of said rails.

8. An accessory arrangement as defined in claim 7, wherein said first connectors include at least a few suction cups located under and secured to said cross-members, for adhering to said top wall, board encircling flexible straps attached to said chassis and strap tighteners for said straps.

9. An accessory arrangement as defined in claim 7, wherein said first connectors includes at least a few suction cups located under and secured to said cross-members for adhering to said top wall, and screws carried by said chassis to be screwed into screw inserts in said top wall.

10. A kayak type water craft comprising a water buoyant, narrow, elongated board, such as a sail board or surf board, and an arrangement to convert said board into a kayak type paddling craft, said board having a bow, a stern and a top wall, said arrangement comprising a chassis including a pair of spaced generally parallel rails; first connectors firmly securing said chassis to said board over said top wall with said rails extending longitudinally of said board, each rail having a rear end portion and a front end portion, a seat extending transversely of and secured to said rear end portions, a foot rest extending transversely of and slidable on said front end portions; adjustable second connectors releasably securing said foot rest to said rails in longitudinally adjusted position therealong, whereby a user, seated on said seat with his legs on said foot rest and facing towards said bow, may use a double paddle oar for propulsion;

wherein said footrest has a downwardly rearwardly inclined user's feet abutting surface facing said seat, and further including a steering mechanism comprising a rudder mounting plate secured to said stern, a rudder pivotally carried by said plate, a rudder actuator lever rearwardly protruding from said feet abutting surface and located centrally thereof, transversely of said chassis, an upright pivot rod journaled in said footrest forwardly of said surface and to the upper end of which said pivot rod is secured and a cable system connecting said pivot rod and said rudder.

11. A kayak type water craft as defined in claim 10, wherein each of said rails forms a channel, said cable system including a pair of cables extending within the respective channels.

12. An accessory arrangement as defined in claim 10, wherein said cable system includes a pair of cables and effective cable length adjusters to maintain said cables taut between said pivot rod and rudder in any selected adjusted position of said foot rest.

* * * * *

UNITED STATES PATENT AND TRADEMARK OFFICE

CERTIFICATE OF CORRECTION

PATENT NO. : 6,035,799
DATED : March 14, 2000
INVENTOR(S) : K. Louis Lukanovich, et. al.

It is certified that error appears in the above-identified patent and that said Letters Patent is hereby corrected as shown below:

Title page, item [73] Assignee: should read – 9059-5646 QUEBEC INC., instead of QUEBEC INC. --

Signed and Sealed this

Twentieth Day of June, 2000

*Attest:*

Q. TODD DICKINSON

*Attesting Officer*

*Director of Patents and Trademarks*